US006318327B1

(12) United States Patent
Takahashi et al.

(10) Patent No.: US 6,318,327 B1
(45) Date of Patent: Nov. 20, 2001

(54) VALVE SYSTEM FOR INTERNAL COMBUSTION ENGINE

(75) Inventors: Teruo Takahashi; Hiroshi Oshige, both of Tochigi-ken (JP)

(73) Assignee: Nippon Piston Ring Co., Ltd. (JP)

( * ) Notice: Subject to any disclaimer, the term of this patent is extended or adjusted under 35 U.S.C. 154(b) by 0 days.

(21) Appl. No.: 09/583,866

(22) Filed: May 31, 2000

(30) Foreign Application Priority Data

May 31, 1999 (JP) ..... 11-150993
Mar. 30, 2000 (JP) ..... 12-093654

(51) Int. Cl.[7] ..... F10L 3/04
(52) U.S. Cl. ..... 123/188.3
(58) Field of Search ..... 123/188.3, 188.1, 123/190.1, 188.11; 251/368

(56) References Cited

U.S. PATENT DOCUMENTS 5,031,878 * 7/1991 Ishikawa ..... 251/368
5,431,136 * 7/1995 Kenmoku et al. ..... 123/188.3
5,441,024 * 8/1995 Wietig ..... 123/188.3
6,200,688 * 3/2001 Liang et al. ..... 428/544
6,244,234 * 6/2001 Hoeg ..... 123/188.3

* cited by examiner

*Primary Examiner*—Bibhu Mohanty
(74) *Attorney, Agent, or Firm*—Parkhurst & Wendel, L.L.P

(57) ABSTRACT

An internal combustion engine includes, in combination, an intake side valve system and an exhaust side valve system. Each of the valve systems comprises a valve seat and a valve member to be assembled with the valve seat, in which the valve seat has a base member including a matrix of iron-base sintered alloy and a dispersed Si—Cr—Mo—Co group intermetallic compound powder, the intermetallic compound powder having a hardness of Hv600 to Hv1000 and an average particle diameter of 20 to 70 $\mu$m, the matrix being contained at 10 to 50 mass % with reference to total mass of the base member, and the valve member has a base member including a matrix of martensitic steel and a nitriding diffusion layer formed to a valve face of the base member, the nitriding diffusion layer having a hardness of more than Hv500 and a thickness of more than 20 $\mu$m.

18 Claims, 1 Drawing Sheet

VALVE SYSTEM FOR INTERNAL COMBUSTION ENGINE

BACKGROUND OF THE INVENTION

The present invention relates to a valve system or valve mechanism for an internal combustion engine, particularly comprising a valve seat and a valve member having an improved wear and abrasion resistance performance.

In a conventional art, many of internal combustion engines such as of an automobile utilize various kinds of valve seats made from an iron-base (or -based) sintered alloy, and many studies and searches have been performed for improving the wear and abrasion resistance of the valve seat.

In order to improve the wear and abrasion resistance of the valve seat, a prior art provides a method of dispersing hard particles such as Fe—Mo or Fe—W into a base member of the valve seat. In this method, however, in order to improve the wear and abrasion resistance of the valve seat by increasing containing amount (content) of the hard particles, there occurs a problem that a valve member as a counterpart to the valve seat is violently worn.

In order to obviate such problem, there has been studied a valve seat for improving the wear and abrasion resistance, as well as reducing an attacking property against the counterpart, for example, as disclosed in Japanese Patent Laid-open Publication No. HEI 5-43913. This prior art publication discloses a valve seat made from an iron-base sintered alloy prepared by dispersing, into a base member of the iron-base sintered alloy, spherical carbide dispersed type hard particles and/or intermetallic compound dispersed type hard particles which have Micro Vickers hardness of Hv500 to Hv1800 at a ratio of 5 to 25 mass % with r reference to the total mass of the base member. In a case where the valve seat of such structure is used for a valve system of a fluid fuel engine such as using gasoline or Diesel Fuel, lubrication property (lubricity) between the valve member and the valve seat can be maintained by a fuel or combustion product (such as carbon (C)), so that the abrasion between the valve seat and the valve member is suppressed.

Incidentally, in the conventional valve system of a fluid fuel engine, there is mainly used, as an intake side valve system, a valve system comprises a valve seat made from an Fe—C group sintered material and a valve member made from a quenched (hardened) martensitic steel corresponding to SUH1 (JIS G 4311, 9% Cr—3% Si—0.4% C—Fe (balance or remainder), and there is also mainly used, as an exhaust side valve system, a valve system comprises a valve seat infiltrated with copper or copper alloy to a sintered material having a base member of a high-speed tool steel (corresponding to SKH 51) and a valve member formed by forming a padding layer of Stellite No. F (Trade Name: DELORO STELLITE Co. Ltd.) to a valve face of austenitic steel corresponding to SUH35 (JIS G 4311, 21% Cr—4% Ni—9% Mn—0.4% N—0.5% C—Fe (balance)).

However, in an engine using a gas fuel such as natural gas, in comparison with an engine using a fluid fuel, an abrasion between the valve seat and the valve member easily progresses due to intermetallic contact therebetween, and flow due to plastic deformation, adhesion wearing or sliding wearing is caused because of reasons of: (1) no cooling function and lubricating function due to the nature of the gas fuel itself; (2) high environmental temperature in the engine; (3) inferior lubricating function due to less combustion product; (4) inferior lubricating function due to less iron oxide product; and (4) easy generation of corrosion, particularly in the case of CNG (compressed natural gas).

In spite of the above fact, in the prior art, a study or countermeasure in a case of many intermetallic contacts such as caused in the gas fuel engine has not been fully considered and the valve system for the fluid fuel engine was applied to the valve system for the gas fuel engine.

In the case where the valve system for the fluid fuel engine is applied as it is to that for the gas fuel engine, in the intake side valve mechanism, the valve seat, made from the Fe—C group sintered material, is inferior in the lubricating function at an environmental temperature of about 150 to 250° C., and the valve member quenched with the martensitic steel corresponding to SUH1 is inferior in the lubricating property and hardness, thus providing a problem. Further, in the exhaust side valve system, the valve seat made by infiltrating Cu to the sintered material having the base of high-speed tool steel in inferior in self-lubrication property and causes an adhesion abrasion due to the intermetallic contact, and the valve member formed by forming a padding layer of the Stellite No. F to the valve face of the austenitic steel corresponding to SUH35 is inferior in strength against high temperature, thus also providing a problem.

SUMMARY OF THE INVENTION

An object of the present invention is to substantially eliminate defects or drawbacks encountered in the prior art mentioned above and to provide a valve system for an internal combustion engine capable of maintaining excellent wear and abrasion resistance and low attacking property against a counterpart even under a condition that an intermetallic contact will be easily caused between the valve seat and the valve member which constitute the valve system in a case where the valve system is used for the gas fuel engine in a severe usable condition, for example.

This and other objects can be achieved according to the present invention by providing, in one aspect, a valve system for an internal combustion engine comprising a valve seat and a valve member to be assembled with the valve seat, the valve seat having a base member including a matrix of iron-base sintered alloy and a dispersed Si—Cr—Mo—Co group intermetallic compound powder, the intermetallic compound powder having a hardness of Hv600 to Hv1000 and an average particle diameter of 20 to 70 $\mu$m, the matrix being contained at 10 to 50 mass % with reference to total mass of the base member, and the valve member having a base member including a matrix of martensitic steel and a nitriding diffusion layer formed to a valve face of the base member, the nitriding diffusion layer having a hardness of more than Hv500 and a thickness of more than 20 $\mu$m.

In another aspect of the present invention, there is also provided a valve system for an internal combustion engine comprising a valve seat and a valve member to be assembled with the valve seat, the valve seat having a base member including a matrix of iron-base sintered alloy and a dispersed Si—Cr—Mo—Co group intermetallic compound powder, the intermetallic compound powder having a hardness of Hv600 to Hv1000 and an average particle diameter of 20 to 70 μm, the matrix being contained at 10 to 50 mass % with reference to total mass of the base member, and the valve member having a base member including a matrix of austenitic steel and a padding layer formed to a valve face of the base member, the padding layer being formed of satellite group cobalt-base alloy having a hardness of more than Hv400 and a thickness of more than 0.5 mm.

In a further aspect of the present invention, there is also provided a valve system for an internal combustion engine comprising a valve seat and a valve member to be assembled with the valve seat, the valve seat having a base member including a matrix of iron-base sintered alloy and a dispersed Si—Cr—Mo—Co group intermetallic compound powder, the intermetallic compound powder having a hardness of Hv600 to Hv1000 and an average particle diameter of 20 to 70 μm, the matrix being contained at 10 to 50 mass % with reference to total mass of the base member, and the valve member having a base member including a matrix of austenitic steel and a padding layer formed to a valve face of the base member, the padding layer being formed of Si—Cr—Mo—Co group intermetallic compound having a hardness of more than Hv400 and a thickness of more than 0.5 mm.

Further, it is to be noted that the above mentioned valve systems will be effectively utilized, in preferred combination, as intake side valve system and exhaust side valve system of the internal combustion engine, particularly, for the gas fuel engine.

According to these aspect of the present invention mentioned above, in the valve seat, there are dispersed the Si—Cr—Mo—Co group intermetallic compound particles having less attacking property against counterpart and being superior in the lubricity, and on the other hand, in the valve member, there is formed the padding layer comprising the nitriding diffusion layer or the satellite group cobalt-base alloy which is superior in the wear and abrasion resistance, or there is formed the Si—Cr—Mo—Co group intermetallic compound particles having less attacking property against counterpart and being superior in the lubricity. Accordingly, the valve arrangement or structure assembled by these valve systems in combination as intake valve system and exhaust valve system provides superior wear and abrasion resistance even if applied to an internal combustion engine disposed in a severe environment such that lubricity is not achieved by fuel, combustion product and iron oxide, and corrosion is liable to be caused at a high temperature. In this application, the wear and abrasion resistance can be more effectively achieved by selectively combining the valve systems in the above three aspects as intake side valve system and exhaust side valve system of the engine. Particularly, in the present invention, the valve systems can be provided in consideration of the lubricity and attacking property to the counterpart.

In preferred embodiments of the above aspects, at least one or two kinds of elements selected from the group consisting of Ni, Cr, Co, Mo, Cu and V is further added as a matrix component to the base member of the valve seat at a content of 1.0 to 20.0 mass % with respect to total mass of the matrix.

A solid lubricant is further added to the base member of the valve seat at a content of 0.1 to 5.0 mass % with reference to total mass of the base member of the valve seat.

One of Cu, Pb and resin material is infiltrated or impregnated in the base member of the valve seat.

According to the above preferred embodiments, it is possible to strengthen the matrix of the base member and improve the heat resistance thereof. The wear and abrasion resistance may be further improved by adding the solid lubricant. The addition of One of Cu, Pb and resin material will further improve the wear and abrasion resistance.

The nature and further characteristic features of the present invention will be made more clear from the following descriptions.

BRIEF DESCRIPTION OF THE DRAWING

A single drawing of FIG. 1 shows a valve system to which the present invention is applicable.

DESCRIPTION OF THE PREFERRED EMBODIMENTS

Figure 1:
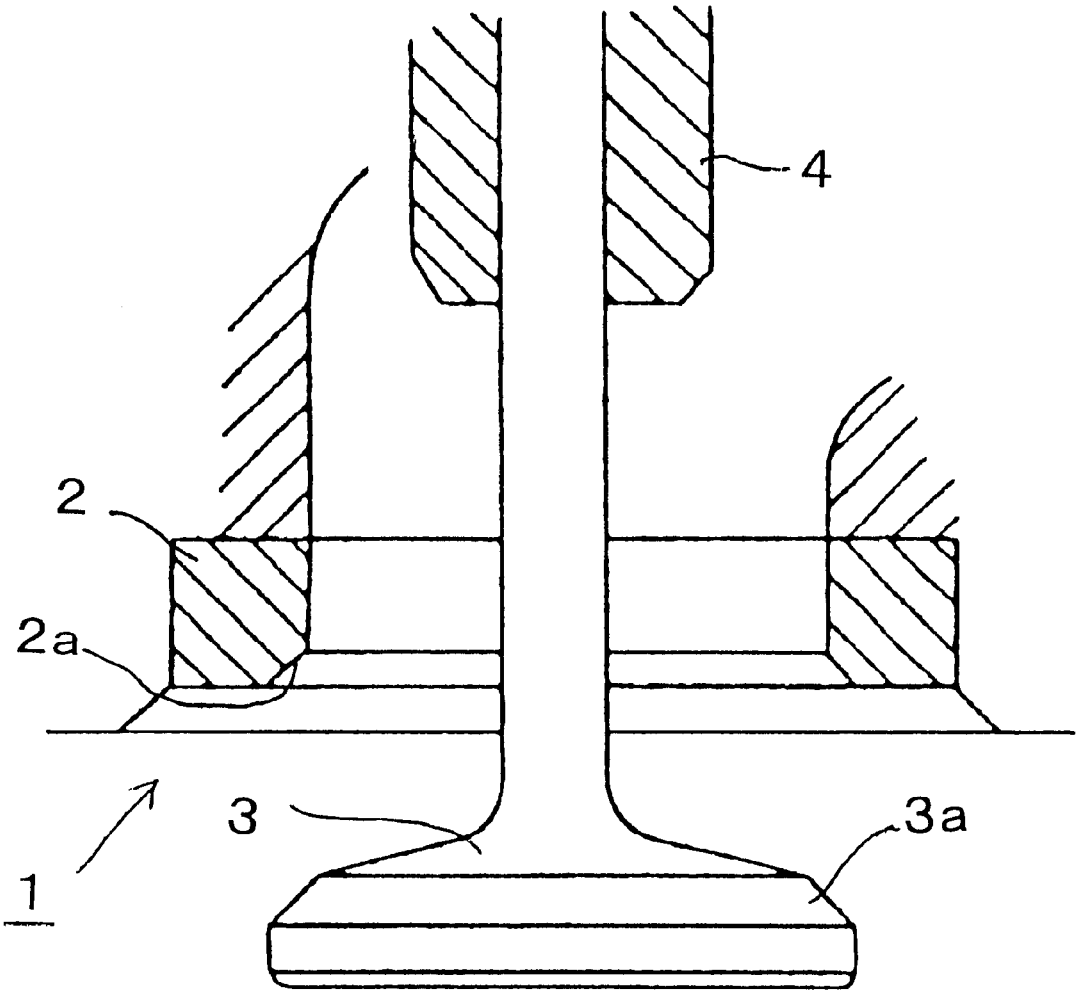

FIG. 1 shows a valve system to which the present invention is applicable. The valve system 1 is of a type to be applied to an internal combustion engine and comprises a valve seat 2 and a valve member 3. The valve seat 2 generally has a ring shape and is provided with a valve contacting face (surface) 2*a*, and the valve member 3 is provided with a valve face (surface) 3*a*. The valve member 3 is fitted to the valve seat 2 to be sidable along a valve guide 4 at a predetermined timing. When the valve member 3 is moved upward in the illustrated state through the guidance of the valve guide 4, the valve face 3*a* of the valve member 3 abuts against the valve contacting face 2*a* of the valve seat 2 to thereby close the valve system 1.

According to the present invention, the valve system 1 generally comprises the valve seat 2 and the valve member 3 mentioned above.

The valve seat 2 includes a base member which is formed of a matrix formed of an iron-base (or -based) sintered alloy and dispersed silicon (Si) -chromium (Cr) -molybdenum (Mo) -cobalt (Co) group intermetallic compound particles. The Si—Cr—Mo—Co group intermetallic compound particles (called intermetallic compound hereinlater) has a hardness of Hv600 to Hv1000 and average particle diameter of 20 to 70 μm and is included at 10–50 mass % with reference to the total mass of the base member of the valve seat 2.

On the other hand, the valve member 3 includes a base member selected from one of following three types: (1) first type in which the base member comprises a matrix of martensitic steel and a valve face to which is formed a nitriding diffusion layer having a hardness of Hv500 or more and a thickness of 20 μm or more; (2) second type in which the base member comprises a matrix of austenitic steel and a valve face to which is formed a padding layer of satellite group cobalt base alloy having a hardness of Hv400 or more and a thickness of 0.5 mm or more (Stellite No. 12 (Trade Name) or Stellite No. 6 (Trade Name) both manufactured by DELORO STELLITE Co. Ltd.); and (3) third type in which the base member comprises a matrix of austenitic steel and a valve face to which is formed a padding layer of Si—Cr—Mo—Co group intermetallic compound having a hardness of Hv400 or more and a thickness of 0.5 mm or more.

The constitutional materials of the valve seat and the valve member described above will be mentioned hereunder further in detail.

(1) Valve Seat

The valve seat 2 has the matrix made of an iron-base sintered alloy, such as Fe—C group sintered alloy, mainly composed of Fe, C, Ni and Co. The content (amount) of C is set so as not to precipitate free ferrite which is harmful to the wear and abrasion resistance and insufficient in the sintering diffusion and further not to precipitate free cementite which lowers machinability, and in this meaning, it is desired for the carbon (C) component to be set 0.8 to 1.2 mass %. The balance is Fe as matrix component and includes unavoidable impurity. In the valve seat 2 according to the present invention, since the intermetallic compound having self-lubricity is dispersed into the matrix made of the iron-base sintered alloy, the material such as Fe—C group mentioned above, which is not expensive and is not applicable itself to the matrix of the valve seat, is preferably applicable to the matrix of the valve seat of the valve system, thus being useful.

The intermetallic compound has less counterpart attacking property and is superior in the lubricity, so that the intermetallic compound can be used mainly for the purpose of improving the wear and abrasion resistance of the valve seat. Furthermore, since the intermetallic compound is also superior in the heat resistance and corrosion resistance, the heat resistance and the corrosion resistance of the valve seat can be also improved even if the valve system is used for the gas fuel engine.

In the case of the hardness of less than Hv600, the wear and abrasion resistance of the valve seat is not improved and in the case of the hardness of more than Hv1000, the stiffness of the valve seat is reduced and the valve member as counterpart will be easily attacked. In the case of the average particle diameter of the intermetallic compound being less than 20 $\mu$m, the particles of the intermetallic compound are too small or fine and, hence, easily diffused in the matrix made of iron-base sintered alloy at the sintering time of the valve seat. In an adverse case, the intermetallic compound may not exist as particles, and in such case, the lubricity will not sufficiently be obtainable. On the other hand, in a case of the average particle diameter of the intermetallic compound being more than 70 $\mu$m, the particles of the intermetallic compound are too coarse or large, and hence, the coupling of the intermetallic compound to the iron-base sintered alloy due to the sintering diffusion will not easily progress, and in an adverse case, the particles may be come off and the effects of the intermetallic compound will not sufficiently be achieved, thus not improving the wear and abrasion resistance of the valve seat.

Still furthermore, in the case where the content of the intermetallic compound is less than 10 mass % with reference to the total mass of the base member of the valve seat, since the intermetallic compound having the lubricity is less in amount, the wear and abrasion resistance of the valve seat will not sufficiently be improved. Further, in a case of more than 50 mass % of the intermetallic compound, property of compressibility and compactibility and strength of the valve seat are deteriorated, thus being inconvenient. Further, the shape of the intermetallic compound is not specifically limited, but the spherical shape is more preferred. As such intermetallic compound, "TRIBALOY T-400 (Trade Name) Representative Component: 2.6% Si—8.5% Cr—28.5% Mo—Co (balance)" (manufactured by NIKKOSHI Co. Ltd.) and "TRIBALOY T-800 (Trade Name) Representative Component: 3.4% Si—17.5% Cr—28.5% Mo—Co (balance)" (manufactured by NIKKOSHI Co. Ltd.) will be usable.

It may be possible to further add, to the base member of the valve seat, one or more than two kinds of elements selected from elements of Ni, Cr, Co, Mo, Cu and V as the matrix component of the iron-base sintered alloy for the purpose of improving the strength of the base member of the valve seat or improving the wear and abrasion resistance thereof Further, it is preferred for the sum of contents (amounts) of the one or more than two kinds of elements selected from these elements of Ni, Cr, Co, Mo, Cu and V to be 1.0 to 20.0 mass % with reference to the total mass of the matrix composed of the iron-base sintered alloy. In a case of less than 1.0 mass % of the contents of the selected elements, the matrix will not be sufficiently strengthened and the wear and abrasion resistance will not be improved. On the other hand, in a case of more than 20 mass % thereof, the effect of the matrix strengthening will be saturated, manufacturing cost will be increased, and the property of compressibility and compactibility and strength will be lowered. Accordingly, the wear and abrasion resistance and the strength of the base member of the valve seat can be easily improved by adding various component elements to the above-mentioned Fe—C group material as occasion demands.

One or more than two kinds of solid lubricants materials (i-e. self-lubricating materials) may be dispersed in the valve seat. The addition of the solid lubricant material avoids intermetallic contact between the valve seat and the valve member, so that the wear and abrasion resistance and the counterpart attacking property can be further improved. There will be listed up, as the solid lubricant material, sulfide (such as MnS, $MoS_2$, $WS_2$ or like), fluoride (such as $CaF_2$ or like), nitride (such as BN or like) and graphite. The content (amount) of the solid lubricant material is usually set to 0.1 to 5.0 mass %, preferably, 2.0 to 5.0 mass %, with reference to the total mass of the base member of the valve seat. In a case of less than 0.1 mass % of the solid lubricant material, the self-lubricity will not sufficiently be improved, and on the other hand, in a case of more than 5.0 mass % thereof, the sintering dispersion will not be promoted and the wear and abrasion resistance will be easily lowered due to the lowering of the strength of the coupling force between the particles of the intermetallic compound.

At the time of manufacturing the valve seat made of the iron-base sintered alloy, the quenching (hardening) treatment, which is carried out in the conventional technology, may be optionally eliminated. Further, there is usable, as the material powder for the matrix of the valve seat, a material powder of an iron-base alloy powder containing one of more than two kinds of matrix component elements such as C, Cr, V, Ni, Co and Mo, a material powder mainly comprising the iron-base alloy powder, or a non-alloy mixture material powder in which another matrix component powder is mixed with a pure iron powder.

When the valve seat is manufactured, at first, the powder for the matrix of the iron-base sintered alloy, the intermetallic compound powder and the solid lubricant material, which is added as occasion demands, are mixed and then compressed and molded. Next, the thus obtained powder material is sintered in a vacuum furnace to thereby manufacture the valve seat.

The thus manufactured valve seat made of the iron-base sintered alloy has a composition in which pearite, martensite and high-alloy phase exist in mixture. The high-alloy phase mentioned above is an austenite phase having a high diffusion density of the matrix component elements mentioned hereinbefore and having high hardness (preferably, Hv500 to Hv700). Providing that an area ratio of a portion of the matrix composed of the iron-base sintered alloy, except hard particles, is 100% of area ratio, ratios of the respective compositions in the matrix are: 5 to 15% of the pearite; 30 to 60% of martensite; and 30 to 60% of high alloy phase, and preferably, 5 to 10% of pearite; 40 to 50% of martensite; and 40 to 50% of high alloy phase.

Pores exist in the base member of the thus manufactured valve seat, and any metal having a low melting point may be infiltrated into the pores or a resin may be impregnated thereinto. The infiltrated low melting point metal or the impregnated resin exist between the valve member and the valve seat to function as a lubricant to prevent the direct contact between the metallic surfaces of the valve member and the valve seat, thus imparting the improved wear and wear and abrasion resistance and the small attacking property against the counterpart to the valve seat. Examples of the metal having the low melting point may include lead (Pb), zinc (Zn) tin (Sn), copper (Cu) and an alloy containing at least one or more than two kinds of elements selected therefrom. Further, acrylic group resin or polyester group resin may be selected as the resin material.

The rate of the pores (called porosity hereunder) in the base member of the valve seat is usually in a range of 2 to 20% with reference to the entire volume of the base member, and preferably, in a range of 5 to 10%. If the porosity is smaller than 2%, an amount of the infiltrated metal may be insufficient, and on the other hand, if the porosity is larger than 20%, the wear and abrasion resistance is liable to be deteriorated due to the decrease in bonding strength between the particles and the decrease in strength of the base member of the valve seat.

The thus obtained valve seat may be subjected to a water steam treatment. The water steam treatment is performed by heating as usual the valve seat in heated steam ambient atmosphere at a temperature of about 550° C. and forming an oxide film ($Fe_3O_4$). The thus formed oxide film has a self-lubricity and functions to suppress the adhesion to the valve member as the counterpart at the friction. Further, since the oxide film is a porous material, an improved wear and abrasion resistance can be achieved.

As mentioned hereinbefore, the valve seat 2 utilized for the valve system 1 according to the present invention applicable to the internal combustion engine is superior in the wear and abrasion resistance and the self-lubricity, so that the valve seat can be effectively utilized for both the intake and exhaust side valve systems.

(2) Valve Member

As mentioned hereinbefore, the valve member 3 of the valve system 1 includes three types, and the first-type valve member is utilized in combination of the valve seat 2 of the structure and characters mentioned above.

In the base member of the valve member, the matrix formed of the martensitic steel has a valve face to which a nitriding diffusion layer is formed for the purpose of improving the wear and abrasion resistance and ensuring the strength of the base member. The matrix formed of the martensitic steel has a component composition corresponding to SUH11 (JIS G 4311) having the representative composition of 9% Cr—1.5% Si—0.5% C—Fe (balance). The balance includes an unavoidable (inevitable) impurity. Further, in the present invention, any quenching is not needed.

The second- and third-type valve members 3 are also utilized in combination of the valve seat 2 of the structure and characters mentioned above. In the base member of the valve member, the matrix formed of the austenitic steel has a valve face to which a padding layer is formed for the purpose of improving the wear and abrasion resistance and ensuring the strength of the base member. The matrix formed of the austenitic steel has a component composition corresponding to SUH35 (JIS G 4311) having the representative composition of 21% Cr—4Ni—9% Mn—0.4% N—0.5% C—Fe (balance). The balance includes an unavoidable (inevitable) impurity.

In the first-type valve member formed with the nitriding diffusion layer, the nitriding diffusion layer can be formed by a usual method. The wear and abrasion resistance of the valve member cannot be improved in the case of the nitriding diffusion layer having the hardness of less than Hv500. The upper limit of the hardness of the nitriding diffusion layer is Hv1000 in an actual manufacture. Further, in the case of the nitriding diffusion layer having the thickness of less than 20 $\mu$m, as the abrasion progresses, the diffusion layer is vanished, and in such a case, there is a fear that the abrasion will further progress. The upper limit of the thickness of the nitriding diffusion layer is 100 $\mu$m in an actual manufacture. The nitriding diffusion layer in this example has a hardness higher than that of the valve face of the material corresponding to the conventional quenched SUH1 and has a wear and abrasion resistance superior to that of the conventional one.

In the second-type valve member to which the padding layer formed of the satellite group cobalt-base alloy, a Stellite No. 12 (Trade Name) or Stellite No. 6 (Trade Name) is used as the satellite group cobalt-base alloy. In a case of the padding layer having a hardness of less than Hv400, the wear and abrasion resistance and strength cannot be sufficiently improved. Further, the upper limit of the hardness of the padding layer being less than 0.5 mm, as the abrasion progresses, the padding layer excellent in the lubricity is vanished and, hence, the abrasion further progresses, so that there is a fear of causing a lowering of a compression ratio of the engine. The upper limit of the thickness of the padding layer is 2 mm in an actual manufacture. The padding layer of the present invention has a high temperature strength and is superior in the wear and abrasion resistance in comparison with those of the padding layer formed in the use of the conventional Stellite No. F (Trade Name: DELORO STELLITE Co. Ltd.), so that the second-type valve member formed of such padding layer is preferably utilized for a gas fuel engine. The Stellite No. 12 (Trade Name) used for the second-type valve member has a representative composition of 29% Cr—9% W-1.8% C—Co (balance), and the Stellite No. 6 (Trade Name) used therefor has a representative composition of 26% Cr—5% W—1% C—Co (balance). The padding layer is formed to the valve face of the matrix of the valve member by thermally spraying these satellite group cobalt-base apply.

In the third-type valve member formed with the padding layer composed of Si—Cr—Mo—Co series intermetallic compound, as the intermetallic compound for the padding layer, there is used the same one as that dispersed in the base member of the valve seat mentioned hereinbefore. That is, there is used TRIBALOY 400 (Trade Name) or TRIBALOY 800 (Trade Name), and the TRIBALOY 400 is preferred. In a case of the padding layer having the hardness of less than Hv400, it is impossible to improve sufficient wear and abrasion resistance and strength thereof. Further, the upper limit of the hardness of the padding layer is Hv1000 in an actual manufacture. In a case of the padding layer having a thickness less than 0.5 mm, as the abrasion progresses, the padding layer excellent in lubricity is vanished and the abrasion progresses, so that there is a fear of causing the lowering of the compression ratio of the engine. Further, the upper limit of the thickness of the padding layer is 2 mm in an actual manufacture thereof.

In an actual use of the valve system utilizing the valve seat and the valve members mentioned above, the valve members of the above-mentioned three-types, in order to effectively solve the problem of the wear or abrasion, it is particularly desirable to use the first-type valve member for the intake side valve system, the second- or third-type valve member for the exhaust side valve system.

The valve seat used for the intake side and exhaust side valve systems includes the Si—Cr—Mo—Co group intermetallic compound having less attacking property against a counterpart and excellent lubricity, so that the valve system provided with such valve seat in combination of the first- to third-type valve members can provide an excellent wear and abrasion resistance and a low counterpart attacking property even be used for the internal combustion engine, such as gas fuel engine, which does not provide an excellent lubricity because of the fuel or combustion product, provides insufficient wear and abrasion resistance and is liable to easily corrode at a high temperature atmosphere.

According to the valve system for the internal combustion engine of the present invention, the padding layer composed of the nitriding diffusion layer excellent in the wear and abrasion resistance and the satellite group cobalt-base alloy or composed of the Si—Cr—Mo—Co group intermetallic compound excellent in the lubricity is formed to the valve face of the valve member as the counterpart to the valve seat, so that the durability sufficient for the valve system can be realized.

Preferred embodiments of the present invention will be described =hereunder with reference to Experimental Examples of the present invention and Comparative Examples. In the embodiments, the Experimental Examples 1 to 4 and the Comparative Examples 1 to 3 are made for the intake side valve system. Further, the following Table 1 shows compound components and compound amounts mixed to the valve seat and materials for forming the valve face of the valve member.

TABLE 1

| | | | Valve seat | | | | | | | Valve member | |
|---|---|---|---|---|---|---|---|---|---|---|---|
| | | | dispersed particles contained in base member of valve seat | | | | component | solid | | | |
| | | | kind of contained intermetallic compound | hardness (Hv) | average particle diameter ($\mu$m) | content (mass %) | composition added to matrix (mass %) | lubricant or other treatment | matrix material | treatment to valveface; hardness; thickness or like |
| Intake side valve system | Experimental Example | 1 | 2.6Si—8.5Cr—28.5Mo—Co(balance) | 750 | 35 | 15 | 3Ni—3Co | $CaF_2$:2.0% | SUH11 | nitriding diffusion layer: Hv600 50 $\mu$m |
| | | 2 | 2.6Si—8.5Cr—28.5Mo—Co(balance) | 750 | 40 | 25 | 6Ni—4Co—3Cr—0.3V | MnS:2.0% | SUH11 | nitriding diffusion layer: Hv800, 40 $\mu$m |
| | | 3 | 2.6Si—8.5Cr–28.5Mo—Co(balance) | 750 | 40 | 25 | 6Ni—4Co—3Cr—0.3V | Pb - impregnation | SUH11 | nitriding diffusion layer: Hv800, 40 $\mu$m |
| | | 4 | 3.4Si—17.5Cr—28.5Mo—Co(balance) | 800 | 45 | 35 | — | — | SUH11 | nitriding diffusion layer: Hv700, 30 $\mu$m |
| | Comparative Example | 1 | not exist | — | — | — | 2.0Cu | — | SUH11 | quenching |
| | | 2 | Fe—Mo hard particle powder | 1000 | 50 | 10 | 4.0Cu | MnS:1.0% | SUH1 | quenching |
| | | 3 | 2.6Si—8.5Cr—28.5Mo—Co(balance) | 750 | 40 | 25 | 6Ni—4Co—3Cr | MnS:2.0% | SUH1 | quenching |
| Exhaust side valve system | Experimental Example | 5 | 2.6Si—8.5Cr—28.5Mo—Co(balance) | 750 | 35 | 40 | 6Ni—3Cr | $WS_2$:1.0% | SUH35 | padding layer: Stellite No. 6 |
| | | 6 | 2.6Si—8.5Cr—28.5Mo—Co(balance) | 750 | 35 | 40 | 6Ni—3Cr | $WS_2$:1.% | SUH35 | padding layer: Stellite No. 12 |
| | | 7 | 2.6Si—8.5Cr—28.5Mo—Co(balance) | 800 | 35 | 40 | 6Ni—3Cr | $WS_2$:1.0% | SUH35 | padding layer: 2.6Si—8.5Cr—28.5Mo—Co(bal.) |
| | | 8 | 3.4Si—17.5Cr—28.5Mo—Co(balance) | 800 | 40 | 30 | 2Ni—1Cu—0.5Mo | Pb - impregnation | SUH35 | padding layer: 2.6Si—8.5Cr—28.5Mo—Co(bal.) |
| | | 9 | 3.4Si—17.5Cr—28.5Mo—Co(balance) | 600 | 30 | 35 | — | Cu - infiltration | SUH35 | padding layer: Stellite No. 12 |
| | Comparative Example | 4 | high-speed-steel powder (SKH51) | 600 | 60 | 70 | — | Cu - infiltration | SUH35 | padding layer: Stellite No. F |
| | | 5 | high-speed-steel powder (SKH51) | 600 | 60 | 70 | 1Cr | steam treatment | SUH35 | padding layer: Stellite No. F |
| | | 6 | 2.6Si—8.5Cr—28.5Mo—Co(balance) | 750 | 40 | 40 | 6Ni—3Cr | MnS:2.0% | SUH35 | padding layer: Stellite No. F |
| | | 7 | high-speed-steel powder (SKH51) | 600 | 60 | 70 | — | Cu - infiltration | SUH35 | padding layer: Stellite No. 12 |

EXPERIMENTAL EXAMPLE 1

The valve seat was prepared in a manner that the Si—Cr—Mo—Co group intermetallic compound particles are dispersed in the matrix of the iron-base sintered alloy. First, as powders of the matrix of the iron-base sintered alloy, there was prepared powders containing, with Fe—1% C (mass %) being a base component composition, Ni and Co both of 3 mass % as additional component compositions. Further, the balance (remainder) included unavoidable impurity. The powders for the base member of the valve seat was obtained by mixing, by using a V-type mixing machine for 10 minutes, powders for the matrix of the composition mentioned above, the TRIBALOY T-400 (Trade Name, representative composition: 2.6% Si—8.5% CR—28.5% Mo—Co (balance), manufactured by NIKKOSHI Co. Ltd.) as intermetallic compound powder and the solid lubricant composed of $CaF_2$. In this mixing process, the intermetallic compound powder has a hardness of Hv750 and an average particle diameter is 35 $\mu$m and was mixed so as to have 15.0 mass % with reference to the total mass of the base member of the obtainable valve seat. The solid lubricant formed of $CaF_2$ was mixed so as to have 2.0 mass % with reference to the total mass of the base member of the obtainable valve seat. In the next process, the powders for the base member were compressed and shaped to a shape of the target valve seat by using a hydraulic press. The thus obtained powders were sintered and treated by a vacuum furnace for 30 minutes at a temperature of 1160° C. and then cooled at a cooling speed of 400° C./hr. In such manner, the valve seat was prepared.

For the preparation of the valve member, a martensitic steel having a component composition corresponding to SUH11 (JIS G 4311) was used as the matrix of the valve member, and the nitriding diffusion layer was formed on the valve face of the matrix. The nitriding diffusion layer was formed through a salt-bath nitriding method so as to have a hardness of Hv600 and a thickness of 50 $\mu$m.

An intake side valve system was constituted by the valve seat and the valve member prepared by the processes mentioned above as Example 1 of the present invention.

EXPERIMENTAL EXAMPLE 2

For the preparation of the valve seat, the additional component compositions of the powders of the matrix of the iron-base sintered alloy, the average particle diameter and mixing amount of the intermetallic compound powders to be mixed and the kind of the solid lubricant were changed, respectively, in comparison with the above Example 1, and the other conditions were substantially the same as those in the Example 1. Further, for the preparation of the valve member, the valve member was prepared with substantially the same conditions as those in the Example 1 except for the changing of the hardness and thickness of the nitriding diffusion layer.

An intake side valve system was constituted by the valve seat and the valve member prepared by the processes mentioned above as Example 2 of the present invention.

EXPERIMENTAL EXAMPLE 3

For the preparation of the valve seat, the powder mixed with no solid lubricant was used as the base member powder and the other conditions were substantially the same as those in the Example 2. The thus prepared valve seat was placed in a vacuum vessel for bleeding air in pores, and then, dipped in a molten lead (Pb) and a pressure is applied to impregnate the Pb as the solid lubricant to thereby prepare the valve seat of the Example 3. For the preparation of the valve member, the valve member was prepared with substantially the same conditions as those in the Example 2.

An intake side valve system was constituted by the valve seat and the valve member prepared by the processes mentioned above as Example 3 of the present invention.

EXPERIMENTAL EXAMPLE 4

For the preparation of the valve seat, any additional component composition was not added to the powder for the matrix of the iron-base sintered alloy and the kind and mixing amount of the intermetallic compound powder to be mixed were changed. The other conditions were substantially the same as those in the Example 1. Any solid lubricant was not added. For the preparation of the valve member, the valve member was prepared with substantially the same conditions as those in the Example 1 except that the hardness and thickness of the nitriding diffusion layer were changed.

An intake side valve system was constituted by the valve seat and the valve member prepared by the processes mentioned above as Example 4 of the present invention.

COMPARATIVE EXAMPLES 1–3

For the valve seat, the valve seats were prepared by changing the powder component for the matrix of the iron-base sintered alloy, the kinds and mixing amounts of the intermetallic compound powders to be mixed and the solid lubricants, and the other conditions were substantially the same as those in the Experimental Example 1. For the preparation of the valve member, a martensitic steel having component composition corresponding to SUH1 (JIS G 4311) was used and then quenched.

Intake side valve systems were constituted by the valve seats and the valve members prepared by the processes mentioned above as Comparative Example 1–3.

The preparation of the exhaust side valve systems will be mentioned hereunder with reference to Experimental Examples 5–9 and Comparative Examples 4–7. Further, mixing components and mixing amounts to be mixed with the valve seat and the forming material to the valve face of the valve member are shown in Table 1 as in the above Examples.

EXPERIMENTAL EXAMPLE 5

The valve seat was prepared in a manner that the Si—Cr—Mo—Co group intermetallic compound particles were dispersed in the matrix of the iron-base sintered alloy. First, as powders of the matrix of the iron-based sintered alloy, there was prepared powder containing, with Fe-1% C (mass %) being a base component composition, Ni (6 mass %) and Cr (3 mass %) as additional component compositions. Further, the balance (remainder) included unavoidable impurity. The powder for the base member of the valve seat was obtained by mixing, by using a V-type mixing machine for 10 minutes, powder for the matrix of the composition mentioned above, the TRIBALOY T-400 (Trade Name: manufactured by NIKKOSHI Co. Ltd.) as intermetallic compound powder and the solid lubricant composed of $WS_2$. In this mixing process, the intermetallic compound powder had a hardness of Hv750 and an average particle diameter was 35 $\mu$m and was mixed so as to have 40.0 mass % with reference to the total mass of the base member of the obtainable valve seat. The solid lubricant formed of $WS_2$ was mixed so as to have 1.0 mass % with reference to the total mass of the base member of the obtainable valve seat. In the next process, the powders for the base member ware compressed and shaped to a shape of the target valve seat by using a hydraulic press. The thus obtained powder was sintered and treated by a vacuum furnace for 30 minutes at a temperature of 1160° C. and then cooled at a cooling speed of 400° C./hr. In such manner, the valve seat was prepared.

For the preparation of the valve member, an austenitic steel having a component composition corresponding to SUH35 (JIS G 4311) was used as the matrix of the valve member, and a padding layer, which is formed of Stellite No. 6 (Trade Name, DELORO STELLITE Co. Ltd.) and has a hardness of Hv550 and a thickness of 0.7 mm, was formed on the valve face of the matrix.

An exhaust side valve system was constituted by the valve seat and the valve member prepared by the processes mentioned above as Example 5 of the present invention.

EXPERIMENTAL EXAMPLE 6

For the preparation of the valve seat, the same valve seat as that in the Example 5 was used. For the valve member, a padding layer was formed by thermally spraying a material of Stellite No. 12 (Trade Name, DELORO STELLITE Co. Ltd.) on the valve face of the matrix of the valve member so as to have a hardness of Hv540 and a thickness of 0.6 mm.

An exhaust side valve system was constituted by the valve seat and the valve member prepared by the processes mentioned above as Example 6 of the present invention.

EXPERIMENTAL EXAMPLE 7

For the preparation of the valve seat, the same valve seat as that in the Example 5 was used. For the valve member, a padding layer was formed by thermally spraying a material of TRIBALOY T-400 (Trade Name, NIKKOSHI Co. Ltd.) on the valve face of the matrix of the valve member so as to have a hardness of Hv550 and a thickness of 0.6 mm.

An exhaust side valve system was constituted by the valve seat and the valve member prepared by the processes mentioned above as Example 7 of the present invention.

EXPERIMENTAL EXAMPLE 8

For the preparation of the valve seat, there was used powder for the base member in which the powder composition for the matrix of the iron-base sintered alloy and the kind and mixing amount of the intermetallic compound powder to be mixed were changed and any solid lubricant was not mixed. The conditions other than the above matters are substantially the same as those in the Example 5. Further, the thus prepared valve seat was placed in a vacuum vessel for bleeding air in pores, and then, dipped in a molten lead (Pb) and a pressure is applied to impregnate the Pb as the solid lubricant to thereby prepare the valve seat of the Example 8. For the preparation of the valve member, the valve member was prepared with substantially the same conditions as those in the Example 7.

An exhaust side valve system was constituted by the valve seat and the valve member prepared by the processes mentioned above as Example 8 of the present invention.

EXPERIMENTAL EXAMPLE 9

For the preparation of the valve seat, there was used sintered powder for the base member in which the powder composition for the matrix of the iron-base sintered alloy and the average particle diameter and mixing amount of the intermetallic compound powder to be mixed were changed and any solid lubricant was not mixed. The conditions other than the above matters are substantially the same as those in the Example 5. Further, a copper (Cu) ring was placed on the thus prepared valve seat and then fused at a temperature of 1130° C. to thereby prepare the valve seat of the Example 9. For the preparation of the valve member, the valve member was prepared with substantially the same conditions as those in the Example 6.

An exhaust side valve system was constituted by the valve seat and the valve member prepared by the processes mentioned above as Example 9 of the present invention.

COMPARATIVE EXAMPLES 4–7

For the valve seat, the valve seat was prepared in a manner that the powder component for the matrix of the iron-base alloy, the kinds and mixing amounts of the intermetallic compound to be mixed and the kinds of the solid lubricants were changed, whereas conditions other than the above matters were not changed and were the same as those in the (Experimental) Example 5 mentioned above.

For the preparation of the valve member, the valve member was prepared with substantially the same conditions as those in the Example 5 except that the kinds of the padding layers were changed.

Exhaust side valve systems were constituted by the valve seats and the valve members prepared by the processes mentioned above as Comparative Examples 4–7.

Evaluation of Wear and Abrasion Resistance

In order to evaluate the valve systems obtained by the respective Experimental Examples and Comparative Examples, the valve systems were actually mounted or incorporated to engines each of 1800 cc, in-line four-cylinder, four-stroke-cycle type using a natural gas fuel. Durabilities of these engines (valve systems) were evaluated with conditions of 6000 rpm/WOT (full open operation) for 200 Hr testing time. After the tests, variation of valve clearance were measured. In these tests, the aimed or desired variation of valve clearance were preliminarily set to be 0.10 mm for the intake side valve system and to be 0.20 mm for the exhaust side valve system.

The following Table 2 shows the results of these tests. In view of the results shown in Table 2, variation of valve clearance of the intake side valve systems in the Comparative Examples all exceeded the set desired value of 0.10 mm, whereas variation of valve clearance of the intake side valve systems in the Experimental Examples were all below the set desired valve of 0.10 mm. Furthermore, variation of valve clearance of the exhaust side valve systems in the Comparative Examples all exceeded the set desired value of 0.20 mm, whereas variation of valve clearance of the exhaust side valve systems in the Experimental Examples were all below the set desired valve of 0.20 mm.

TABLE 2

| | | | variation of valve clearance after endurance test (mm) |
|---|---|---|---|
| Intake side valve system | Experimental Example | 1 | 0.05~0.08 |
| | | 2 | 0.03~0.05 |
| | | 3 | 0.02~0.04 |
| | | 4 | 0.04~0.07 |
| | Comparative Example | 1 | 0.39~0.53 |
| | | 2 | 0.28~0.43 |
| | | 3 | 0.16~0.29 |
| Exhaust side valve system | Experimental Example | 5 | 0.05~0.10 |
| | | 6 | 0.04~0.08 |
| | | 7 | 0.02~0.05 |
| | | 8 | 0.05~0.09 |
| | | 9 | 0.09~0.17 |
| | Comparative Example | 4 | 0.50~0.71 |
| | | 5 | 0.39~0.65 |
| | | 6 | 0.21~0.32 |
| | | 7 | 0.35~0.49 |

What is claimed is:

1. A valve system for an internal combustion engine comprising a valve seat and a valve member to be assembled with the valve seat, said valve seat having a base member including a matrix of iron-base sintered alloy and a dispersed Si—Cr—Mo—Co group intermetallic compound powder, said intermetallic compound powder having a hardness of Hv600 to Hv1000 and an average particle diameter of 20 to 70 $\mu$m, said matrix being contained at 10 to 50 mass % with reference to total mass of the base member, and said valve member having a base member including a matrix of martensitic steel and a nitriding diffusion layer formed to a valve face of the base member, said nitriding diffusion layer having a hardness of more than Hv500 and a thickness of more than 20 $\mu$m.

2. A valve system for an internal combustion engine according to claim 1, wherein at least one or two kinds of elements selected from the group consisting of Ni, Cr, Co, Mo, Cu and V is further added as a matrix component to the base member of the valve seat at a content of 1.0 to 20.0 mass % with reference to total mass of the matrix.

3. A valve system for an internal combustion engine according to claim 1, wherein a solid lubricant is further added to the base member of the valve seat at a content of 0.1 to 5.0 mass % with reference to total mass of the base member of the valve seat.

4. A valve system for an internal combustion engine according to claim 1, wherein one of Cu, Pb and resin material is infiltrated or impregnated in the base member of the valve seat.

5. A valve system of an internal combustion engine according to claim 1, wherein said internal combustion engine is for a gas fuel internal combustion engine.

6. A valve system for an internal combustion engine comprising a valve seat and a valve member to be assembled with the valve seat, said valve seat having a base member including a matrix of iron-base sintered alloy and a dispersed Si—Cr—Mo—Co group intermetallic compound powder, said intermetallic compound powder having a hardness of Hv600 to Hv1000 and an average particle diameter of 20 to 70 $\mu$m, said matrix being contained at 10 to 50 mass % with reference to total mass of the base member, and said valve member having a base member including a matrix of austenitic steel and a padding layer formed to a valve face of the base member, said padding layer being formed of satellite group cobalt-base alloy having a hardness of more than Hv400 and a thickness of more than 0.5 mm.

7. A valve system for an internal combustion engine according to claim 6, wherein at least one or two kinds of elements selected from the group consisting of Ni, Cr, Co, Mo, Cu and V is further added as a matrix component to the base member of the valve seat at a content of 1.0 to 20.0 mass % with reference to total mass of the matrix.

8. A valve system for an internal combustion engine according to claim 6, wherein a solid lubricant is further added to the base member of the valve seat at a content of 0.1 to 5.0 mass % with reference to total mass of the base member of the valve seat.

9. A valve system for an internal combustion engine according to claim 6, wherein one of Cu, Pb and resin material is infiltrated or impregnated in the base member of the valve seat.

10. A valve system of an internal combustion engine according to claim 6, wherein said internal combustion engine is for a gas fuel internal combustion engine.

11. A valve system for an internal combustion engine comprising a valve seat and a valve member to be assembled with the valve seat, said valve seat having a base member including a matrix of iron-base sintered alloy and a dispersed Si—Cr—Mo—Co group intermetallic compound powder, said intermetallic compound powder having a hardness of Hv600 to Hv1000 and an average particle diameter of 20 to 70 $\mu$m, said matrix being contained at 10 to 50 mass % with reference to total mass of the base member, and said valve member having a base member including a matrix of austenitic steel and a padding layer formed to a valve face of the base member, said padding layer being formed of Si—Cr—Mo—Co group intermetallic compound having a hardness of more than Hv400 and a thickness of more than 0.5 mm.

12. A valve system for an internal combustion engine according to claim 11, wherein at least one or two kinds of elements selected from the group consisting of Ni, Cr, Co, Mo, Cu and V is further added as a matrix component to the base member of the valve seat at a content of 1.0 to 20.0 mass % with reference to total mass of the matrix.

13. A valve system for an internal combustion engine according to claim 11, wherein a solid lubricant is further added to the base member of the valve seat at a content of 0.1 to 5.0 mass % with reference to total mass of the base member of the valve seat.

14. A valve system for an internal combustion engine according to claim 11, wherein one of Cu, Pb and resin material is infiltrated or impregnated in the base member of the valve seat.

15. A valve system of an internal combustion engine according to claim 11, wherein said internal combustion engine is f or a gas fuel internal combustion engine.

16. A valve arrangement for an internal combustion engine including in combination of an intake side valve system and an exhaust side valve system, said intake side valve system comprising a valve seat and a valve member to be assembled with the valve seat, said valve seat having a base member including a matrix of iron-base sintered alloy and a dispersed Si—Cr—Mo—Co group intermetallic compound powder, said intermetallic compound powder having a hardness of Hv600 to Hv1000 and an average particle diameter of 20 to 70 $\mu$m, said matrix being contained at 10 to 50 mass % with reference to total mass of the base member, said valve member having a base member including a matrix of martensitic steel and a nitriding diffusion layer formed to a valve face of the base member, said nitriding diffusion layer having a hardness of more than Gus Hv500 and a thickness of more than 20 $\mu$m.

17. A valve arrangement for an internal combustion engine including in combination of an intake side valve system and an exhaust side valve system, said exhaust side valve system comprising a valve seat and a valve member to be assembled with the valve seat, said valve seat having a base member including a matrix of iron-base sintered alloy and a dispersed Si—Cr—Mo—Co group intermetallic compound powder, said intermetallic compound powder having a hardness of Hv600 to Hv1000 and an average particle diameter of 20 to 70 $\mu$m, said matrix being contained at 10 to 50 mass % with reference to total mass of the base member, said valve member having a base member including a matrix of austenitic steel and a padding layer formed to a valve face of the base member, said padding layer being formed of satellite group cobalt-base alloy having a hardness of more than Hv400 and a thickness of more than 0.5 mm.

18. A valve arrangement for an internal combustion engine including in combination of an intake side valve system and an exhaust side valve system, said exhaust side valve system comprising a valve seat and a valve member to be assembled with the valve seat, said valve seat having a base member including a matrix of iron-base sintered alloy and a dispersed Si—Cr—Mo—Co group intermetallic compound powder, said intermetallic compound powder having a hardness of Hv600 to Hv1000 and an average particle diameter of 20 to 70 $\mu$m, said matrix being contained at 10 to 50 mass % with reference to total mass of the base member, said valve member having a base member including a matrix of austenitic steel and a padding layer formed to a valve face of the base member, said padding layer being formed of Si—Cr—Mo—Co group intermetallic compound having a hardness of more than Hv400 and a thickness of more than 0.5 mm.

* * * * *